United States Patent [19]

Heger

[11] Patent Number: 4,890,971

[45] Date of Patent: Jan. 2, 1990

[54] WARP-BEAM LIFTING AND TRANSPORT CARRIAGE

[75] Inventor: Winfried Heger, Hofbiber, Fed. Rep. of Germany

[73] Assignee: Hubtex Maschinenbau GmbH, Fulda, Fed. Rep. of Germany

[21] Appl. No.: 911,802

[22] Filed: Sep. 25, 1986

[30] Foreign Application Priority Data

Sep. 26, 1985 [DE] Fed. Rep. of Germany ... 8527486[U]

[51] Int. Cl.[4] ..... D02H 13/38

[52] U.S. Cl. ..... 414/546; 180/19.2; 180/140; 280/91; 414/911

[58] Field of Search ..... 414/426, 428, 469, 470, 414/482, 546, 552, 911; 80/19.2, 79, 140; 280/47.11, 91, 411 B, 412, 413, 411.1

[56] References Cited

U.S. PATENT DOCUMENTS

| | | | |
|---|---|---|---|
| 3,196,971 | 7/1965 | Schantz | 180/19.2 |
| 3,669,466 | 6/1972 | Spence | 280/91 |
| 4,257,619 | 3/1981 | Fisher | 280/91 |
| 4,373,854 | 2/1983 | Schultheis | 414/911 |

FOREIGN PATENT DOCUMENTS

| | | | |
|---|---|---|---|
| 2001625 | 4/1978 | Fed. Rep. of Germany . | |
| 2935624 | 4/1981 | Fed. Rep. of Germany . | |
| 3130328 | 2/1983 | Fed. Rep. of Germany | 414/546 |
| 3130369 | 2/1983 | Fed. Rep. of Germany | 414/546 |

OTHER PUBLICATIONS

Brochure of System Schultheis on Kettbaum-Hubwagen Modell KHW-SEF/2000-3000.

*Primary Examiner*—David A. Bucci

*Attorney, Agent, or Firm*—Foley & Lardner, Schwartz, Jeffery, Schwaab, Mack

[57] ABSTRACT

A warp-beam lifting and transport carriage has an undercarriage with rotatable wheels and at least one wheel fixed in the direction of longitudinal travel. At least one boom, equipped with a roller fixed in the direction of transverse travel, extends obliquely downward and outward from the carriage to lift the longitudinally travelling wheel from the ground when sideways motion is desired. A coupling device changes the steering connection between a drawbar and the rotatable wheels. Steering is accomplished through the coupling device which causes open and crossed chains to act on pinions pivoted on the steerable wheels.

3 Claims, 3 Drawing Sheets

WARP-BEAM LIFTING AND TRANSPORT CARRIAGE

The innovation relates to a warp-beam lifting and transport carriage.

Such a warp-beam lifting and transport carriage is known from the brochure of Messrs. System Schultheis GmbH & Co. Maschinenfabrik "warp-beam lifting carriage model KHW-SEF/2000-3000". This has four steerable wheels which are located at the corners of an elongate rectangle and which are actuated jointly by means of the drawbar. The warp-beam extends parallel to the longer sides of the rectangle. The pairs of rollers at the ends of the rectangle can be disconnected by means of the coupling device, so that the two ends can be steered separately. In the known embodiment, the supporting device comprises two supporting arms pivotable up and down which engage under journals of the warp-beam at the ends of the latter.

The coupling device of a known prior art embodiment is the subject of German Auslegeschrift 20 01 625.

Introducing the warp-beam requires an approach accurate to a millimeter, so that the bearing journals of the warp-beam fit exactly into the bearings of the weaving machine. In this respect, the handling of the known warp-beam lifting and transport carriage can be improved, because when final positioning is obtained and the steering of the pairs of wheels at the two ends is disconnected, two operatives are needed in order to steer the two pairs of wheels simultaneously.

An object of the invention is to further develop a warp-beam lifting and transport carriage, so that, while being actuated by only one person, its maneuverability is improved.

An object of the invention is to facilitate movement of a warp-beam lifting and transport carriage in the longitudinal direction by locating, between steerable wheels, a fixed wheel facing the longitudinal direction of travel and to facilitate movement in the transverse direction by extending a support boom with a roller fixed in the direction of transverse travel for lifting the fixed longitudinal wheel off the ground and to provide a drawbar steerably connected to a coupling device which allows the steerable wheels to steer in the same or opposite directions.

The fixed wheel comes into action in longitudinal travel, that is to say when the supporting device is raised together with the warp-beam and the center of gravity is located on the inside. When the supporting device together with the warp-beam is lowered, that is to say when the center of gravity starts to shift outwards, the boom comes into action with its roller which, in transverse travel only, rests on the ground during final positioning. This feature makes it unnecessary for the undercarriage to have to be able to support from the outset the center of gravity even when the supporting device is lowered. It therefore becomes narrower and more maneuverable in longitudinal travel.

Booms with extendable rollers for lateral support are known per se from German Offenlegungsschrift 2,935,624.

When the warp-beam lifting and transport carriage has been brought in front of the weaving loom and is then introduced and finally positioned in transverse travel, the fixed wheel is raised somewhat as a result of the extension of the boom and put out of action, and the steering is changed over from steering in opposite directions, which occurs in longitudinal travel, to steering in the same direction. As a result, the warp-beam lifting and transport carriage can be steered even in transverse travel and can be maneuvered with the highest possible accuracy by a single operative.

Another object of the invention is an expedient method of steering the wheels of a warp-beam lifting and transport carriage through a coupling device, which provides steering by changing the steering connection through an open chain and a crossed chain arranged one above the other on a steering pivot with pinions.

Another object of the invention is to facilitate a warp-beam lifting and transport carriage steering connection through a coupling device in which independently rotatable pinions on an intermediate shaft are connected via open and crossed chains to shaft mounted pinions on the steering pivot of one steerable wheel, and a middle intermediate shaft pinion, which can be connected to the upper or lower pinion of the intermediate shaft, is connected by another chain to a pinion on the steering pivot of the other steerable wheel.

Another object of the invention is to facilitate connecting the middle pinion to the upper and lower pinions on the intermediate hollow shaft of a warp-beam lifting and transport carriage steering coupling device by an axially displaceable journal with a crosspin, which engages through a slot in the hollow shaft into an inner bearing ring of the middle pinion, so that the middle pinion claws and holes engage with the claws and holes of the upper and lower pinions.

Another object of the invention is to facilitate steering of a warp-beam lifting and transport carriage by an actuating lever and a drawbar.

An exemplary embodiment of the invention is illustrated partly diagrammatically in the drawing.

Figure 1:
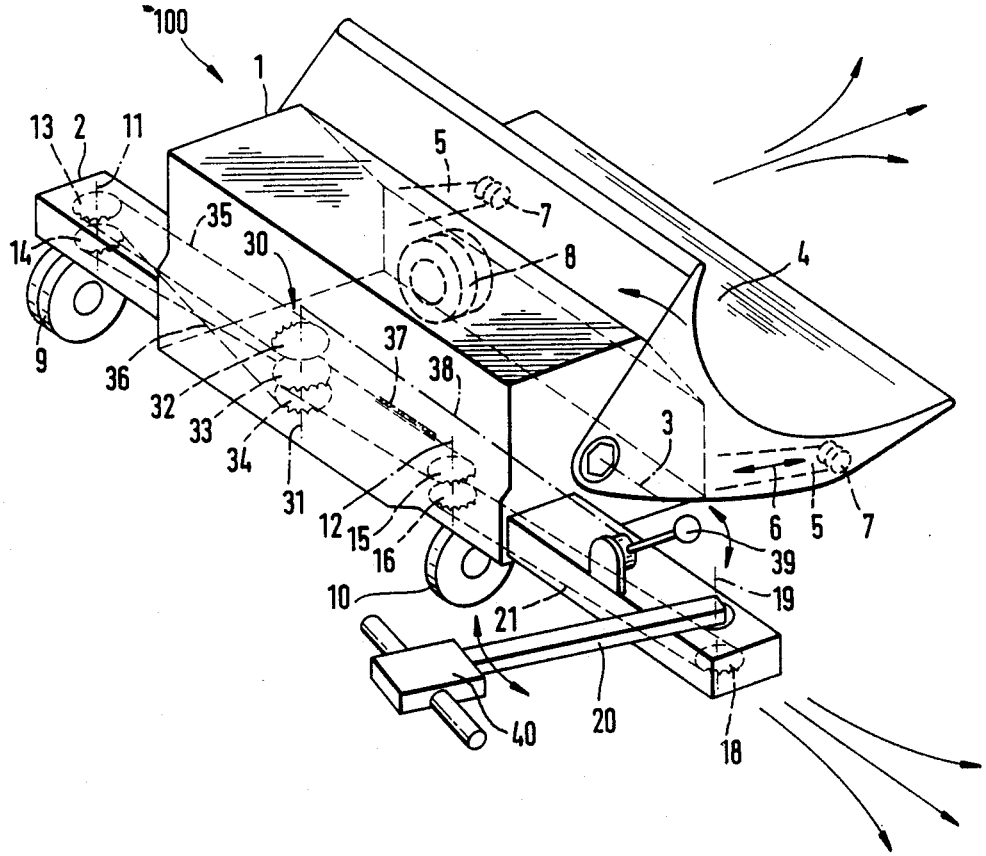
FIG. 1 is a perspective view of a lifting and transport carriage according to the invention.

The warp-beam lifting and transport carriage designated as a whole by 100 comprises an undercarriage with a housing-like superstructure 1 for receiving the electrical drive, the associated batteries and the hydraulic pumps, and a box girder 2 which extends over the entire length of the carriage and which passes through the superstructure 1 on one longitudinal side. The laterally projecting supporting device for the warp-base (not shown) in the form of a trough 4 is mounted on the superstructure 1 so as to be pivotable up and down about a longitudinal axis 3 by means of a hydraulic drive. The trough out of a concave steel plate 4' having backwardly extending side plates 4'' on its ends which are passing adjacent the end walls of superstructure 1 and are supported about axis 3. Under the trough 4, booms 5 are guided on the superstructure 1, at its two ends, so as to be extendable in the direction of the arrow 6. Booms 5 carry rollers 7 at the ends and are coupled in terms of movement to the trough 4, in such a way that, when the trough 4 is lowered, and the center of gravity shifts correspondingly to the right according to FIG. 1, the rollers 7 rest on the ground at the proper time and supports the warp-beam lifting and transport carriage 100 against tipping over to the right.

A wheel 8 mounted so as to be fixed in the direction of longitudinal travel is provided under the superstructure 1. Under the box girder 2, steerable wheels 9, 10 are mounted in front of and behind the wheel in the longitudinal direction on vertical steering pivots 11, 12 merely indicated, on each of which two chain pinions 13, 14 and 15, 16 are arranged fixedly in terms of rotation. At the end of the box girder 2 projecting from the superstructure 1 on the right according to FIG. 1, a drawbar 20 is mounted so as to be pivotable about a vertical axle 19 which carries a chain pinion 18. The pinion 18 is connected to the pinion 16 via a chain 21. Located between the steering pivots 11, 12 in the box girder 2 is a coupling device which is designated as a whole by 30 and which comprises, on a vertical axle 31, chain pinions 32, 33, 34 rotatable independently of one another. The upper pinion 32 is connected to the upper pinion 13 of the steering pivot 11 via a chain 35, and the lower pinion 34 is connected to the lower pinion 14 via a crossed chain 36. The middle pinion 33 is connected to the pinion 15 via a chain 37.

The middle pinion 33 can be connected in terms of rotation either to the upper pinion 32 or to the lower pinion 34. This is carried out by means of an actuating connection 38 in the form of a link arrangement or a push-pull cable, both actuated by a hand lever 39.

The wheel 10 is driven. The travelling mechanism is controlled at the control head 40 of the drawbar 20. The actuating members for controlling the raising and lowering of the trough 4 and the simultaneous extension and retraction of the booms 5 are also located here.

When the drawbar 20 is pivoted about the vertical axle 19, this movement is transmitted to the steering pivot 12 of the wheel 10 and from there, via the chain 37, to the middle pinion 33 of the coupling device 30. The steering connection to the wheel 9 is made from here either via the open chain loop 35 or via the crossed chain loop 36. In the first case, the two wheels 9 and 10 are steered in the same direction, and in the second case they are steered in opposite directions.

Figure 2:
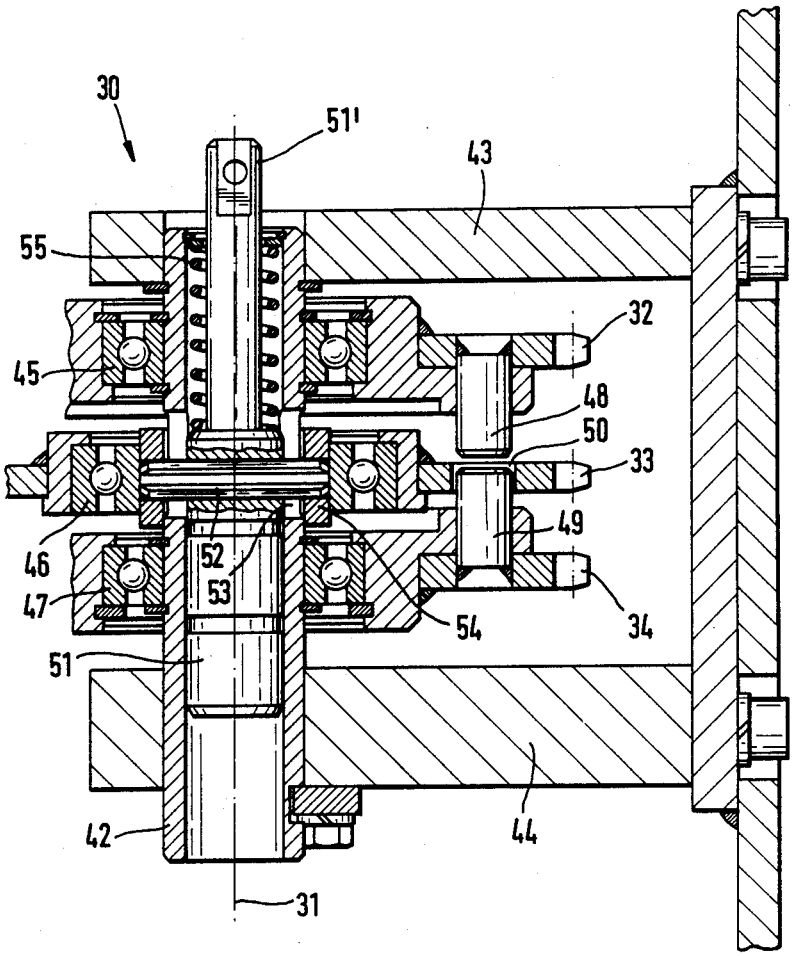
FIG. 2 is a sectional view of the coupling device.

The coupling device 30, merely indicated diagramatically in FIG. 1, is shown in detail in FIG. 2. It comprises a vertical hollow shaft 42 which extends between supporting plates 43, 44 inside the box girder 2 and on which the three pinions 32, 33, 34 are mounted rotatably on ball bearings 45, 46, 47. The two outer pinions 32, 34 are arranged fixedly on the hollow shaft 42 in the axial direction of the latter, while the middle pinion 33 can shift a certain amount in the axial direction of the hollow shaft 42. The pinions 32, 34, on the sides facing one another, have pins 48, 49 which project over the same pitch circle and which can engage into holes 50 in the middle pinion 33. In the switching position shown in FIG. 2, the pinion 33 occupies the lower limiting position, in which the pin 49 of the lower pinion 34 engages into the bore 50 and the pinion 33 is thus connected in terms of rotation to the pinion 34. However, the pinion 33 can be shifted upwards until it releases the pin 49 and, instead, the pin 48 of the pinion 32 engages into the bore 50. The pinion 33 is then connected in terms of rotation to the pinion 32.

It is shifted upwards by means of a plug 51 which is axially displaceable in the hollow shaft 42 and which, in the region of the pinion 33, has a crosspin 52 which passes through a slot 53 on both sides of the hollow shaft 42 and which engages into an inner bearing ring 54, on which the ball bearing 46 is attached with a press fit. Consequently, when the plug 51 is pulled upwards in the hollow shaft 42 by means of a force exerted on its top end 51', the pinion 33 is also taken along with it. The helical compression spring 55 surrounding the top end 51' normally presses the pinion 33 into its lower position.

The actuating connection 38, indicated diagramatically in FIG. 1, engages on the top end 51' via a suitable deflecting means, so that the journal 51 can be shifted by actuating the hand lever 39.

In FIGS. 3 to 6, the particular rollers or wheels resting on the ground are filled in in black, whilst the lifted-up rollers or wheels are shown blank.

Figure 3:
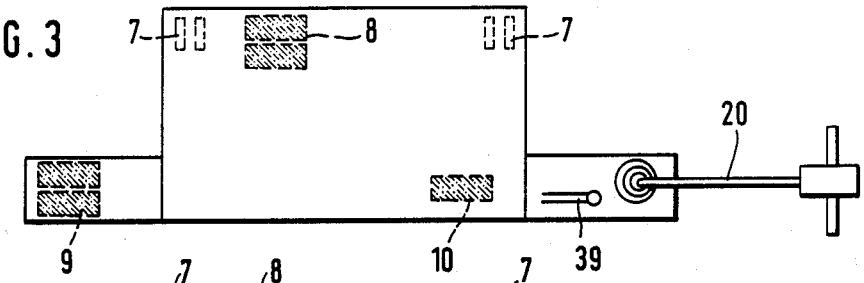
FIGS. 3 to 6 are diagramatic views of the warp-beam lifting and transport carriage from above in different steering positions.

FIG. 3 illustrates the relative positions in longitudinal travel. The warp-beam lifting and transport carriage rests on the wheels 8, 9, 10. The booms 5 together with the rollers 4 are retracted.

Figure 4:
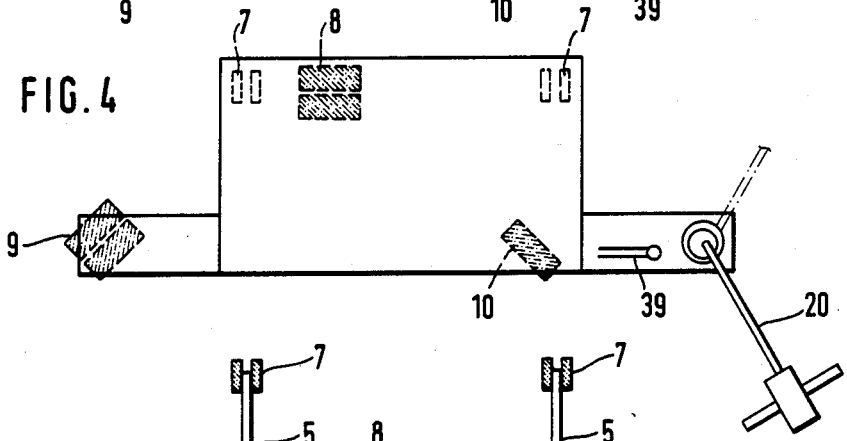

To travel in a curve, the drawbar 20 is pivoted according to FIG. 4, with a result that the wheels 9, 10 are pivoted in opposite directions. At the same time, the wheels 8, 9, 10 run on circles with a common center point, so that the warp-beam lifting and transport carriage executes a circular movement.

Figure 5:
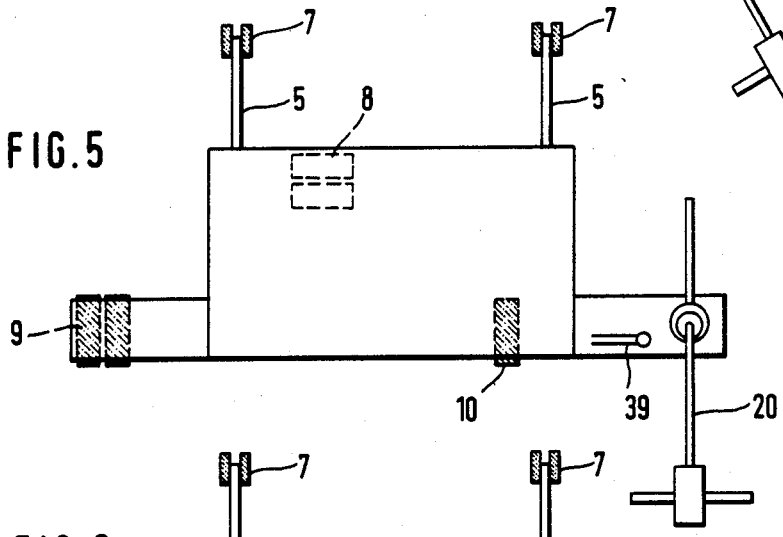

In the position according to FIG. 5, the drawbar 20 is rotated through 90° relative to the position according to FIG. 3. This is when the warp-beam is introduced into the weaving machine. The trough 4 is lowered, with the booms 5 being extended at the same time, until the rollers 7 rest on the ground and support the warp-beam lifting and transport carriage laterally against tipping over when the center of gravity shifts. The wheel 8 is raised slightly by means of the rollers 7 and is out of action, so that, when the drive is actuated via the wheel 10, transverse travel is possible. Since there are two rollers 7 at a longitudinal distance from one another, the fact that the drive takes effect on one side by means of the wheel is of no particular importance.

Figure 6:
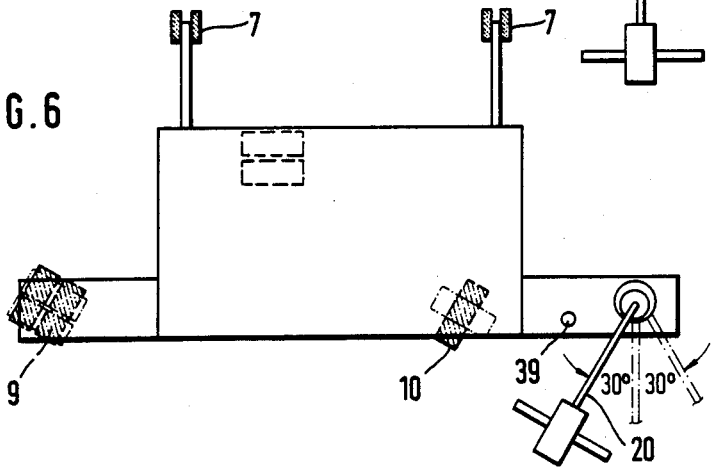

FIG. 6 illustrates the relative positions in steerable transverse travel. When the lever 39 is adjusted, the coupling device 30 is consequently changed over, so that the wheels 9, 10 are now steered in the same direction. The warp-beam lifting and transport carriage can now be introduced into the weaving machine with steering. The steering deviation is limited to approximately ±30° here, so that perfect steering conditions are maintained.

I claim:

1. A warp-beam lifting and transport carriage with an undercarriage having wheels which are arranged on both sides of the longitudinal axis and of which at least one is driven and at least some are steerable, with a drawbar which is pivotable about a vertical axle and which is steerably connected to the steerable wheels, with a coupling device for changing the steering connection between the drawbar and the steerable wheels, and with a supporting device which is intended for the warp-beam and which projects laterally relative to a longitudinal axis of the warp-beam lifting and transport carriage and is pivotable up and down, wherein, (a) two steerable wheels are arranged in succession in the longitudinal direction on the side facing away from the supporting device;

(b) a wheel fixed in a direction of longitudinal travel is provided between the wheels on the side facing the supporting device;

(c) by means of the coupling device the steering connection of the two steerable wheels can be changed over from steering in the same direction to steering in the opposite direction;

(d) the steering connection of the steerable wheels comprises a chain arrangement acting on pinions on the steering pivots of the steerable wheels, wherein two pinions surrounded respectively by an open chain and a crossed chain are arranged above one another on the steering pivot of one wheel, and werein the steering connection to the other steerable wheel can be changed over from the open chain to the crossed chain by means of the coupling device;

(e) the coupling device comprises three pinions which are arranged above one another on an intermediate shaft and are rotatable independently of one another and of which the upper and the lower are connected respectively via the open and crossed chains to the pinions on the steering pivot of one steerable wheel and the middle pinion is connected via a further chain to a pinion on the steering pivot (12) of the other steerable wheel, and wherein the middle pinion can be connected in terms of rotation either to the upper pinion or to the lower pinion or via a claw coupling.

2. A warp-beam lifting and transport carriage as claimed in claim 1, wherein the intermediate shaft is designed as a hollow shaft (42), and arranged in the hollow shaft (42) is an axially displaceable journal (51), in which is located a crosspin (52) which engages through a slot (53) in the hollow shaft (42) into an inner bearing ring (54) of the middle pinion (33), and wherein, as a result of the displacement of the journal (51), the middle pinion (33) can be shifted between the outer pinions (32, 34) until claws (48, 49) and holes (50) in the middle and in the upper and lower pinions (33; 32, 34) respectively engage with one another.

3. A warp-beam lifting and transport carriage as claimed in claim 1, wherein there is, on one side, a box girder (2) which extends over the entire length of the warp-beam lifting and transport carriage (100) and under which the steerable wheels (9, 10) are mounted, and in which the steering pivots (11, 12) together with the pinions (13, 14; 15, 16), the coupling device (30) and the chain arrangement (21, 35, 36, 37) are arranged, and at one end of which a drawbar (20) and an actuating lever (39) for the coupling device (30) are provided.

* * * * *